US008764497B2

(12) United States Patent
Fehling et al.

(10) Patent No.: US 8,764,497 B2
(45) Date of Patent: Jul. 1, 2014

(54) ELECTRICAL CONTACT PART

(75) Inventors: Stephan Fehling, Lage (DE); Georg Kulturidi, Bielefeld (DE); Matthias Niggemann, Doerentrup (DE); Klaus Pueschner, Detmold (DE); Michael Schnatwinkel, Herford (DE); Ralf Schumacher, Lemgo (DE); Klaus Wohlgemuth, Kalletal (DE); Marco Waldhoff, Sandebeck (DE); Gerhard Eggert, Detmold (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 34 days.

(21) Appl. No.: 13/808,097

(22) PCT Filed: Jul. 13, 2011

(86) PCT No.: PCT/EP2011/061985

§ 371 (c)(1),
(2), (4) Date: Jan. 2, 2013

(87) PCT Pub. No.: WO2012/007518

PCT Pub. Date: Jan. 19, 2012

(65) Prior Publication Data

US 2013/0109252 A1 May 2, 2013

(30) Foreign Application Priority Data

Jul. 15, 2010 (DE) ..... 20 2010 010 275 U

(51) Int. Cl.
*H01R 4/48* (2006.01)

(52) U.S. Cl.
USPC ..... 439/862; 439/629

(58) Field of Classification Search
USPC ..... 439/65, 629–631, 907, 928, 861, 862
See application file for complete search history.

(56) References Cited

U.S. PATENT DOCUMENTS

| | | | | |
|---|---|---|---|---|
| 4,322,120 | A | 3/1982 | Rilling | |
| 4,753,614 | A * | 6/1988 | Weiner | 439/717 |
| 4,897,054 | A * | 1/1990 | Gilissen et al. | 439/631 |
| 6,780,027 | B2 * | 8/2004 | Allison | 439/79 |
| 2009/0275218 | A1 | 11/2009 | Yu et al. | |

FOREIGN PATENT DOCUMENTS

| | | | |
|---|---|---|---|
| DE | 29713960 | U1 | 1/1998 |
| DE | 19718996 | C1 | 6/1998 |
| DE | 19826390 | A1 | 12/1999 |
| DE | 19964156 | A1 | 9/2000 |
| DE | 29916302 | U1 | 4/2001 |
| EP | 1289070 | A2 | 3/2003 |
| EP | 1289070 | B1 | 1/2007 |

* cited by examiner

*Primary Examiner* — Khiem Nguyen
(74) *Attorney, Agent, or Firm* — Lawrence E. Laubscher, Sr.; Lawrence E. Laubscher, Jr.

(57) ABSTRACT

An electrical contact arrangement includes a planar conductive metal blank having sections that are foldable to define pairs of orthogonally arranged component contacts and bus blade contacts. Connected with a first pair of opposed side edges of a horizontal rectangular core section of the blank are a pair of rectangular component contact sections that are upwardly bent to define a pair of component contacts for receiving therebetween an electrical component, such as a printed circuit board. Connected with the orthogonally arranged second pair of opposed side edges of the core section are a pair of rectangular support sections that are bent downwardly, whereby a corresponding pair of bus blade contact sections connected with corresponding edges of the support sections extend in vertical parallel spaced relation to define a pair of bus blade contacts adapted for insertion between the downwardly bent support sections of a corresponding second electrical contact arrangement.

9 Claims, 9 Drawing Sheets

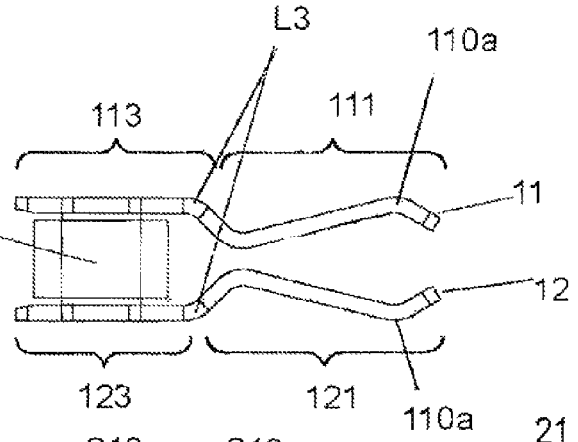
Fig. 1e
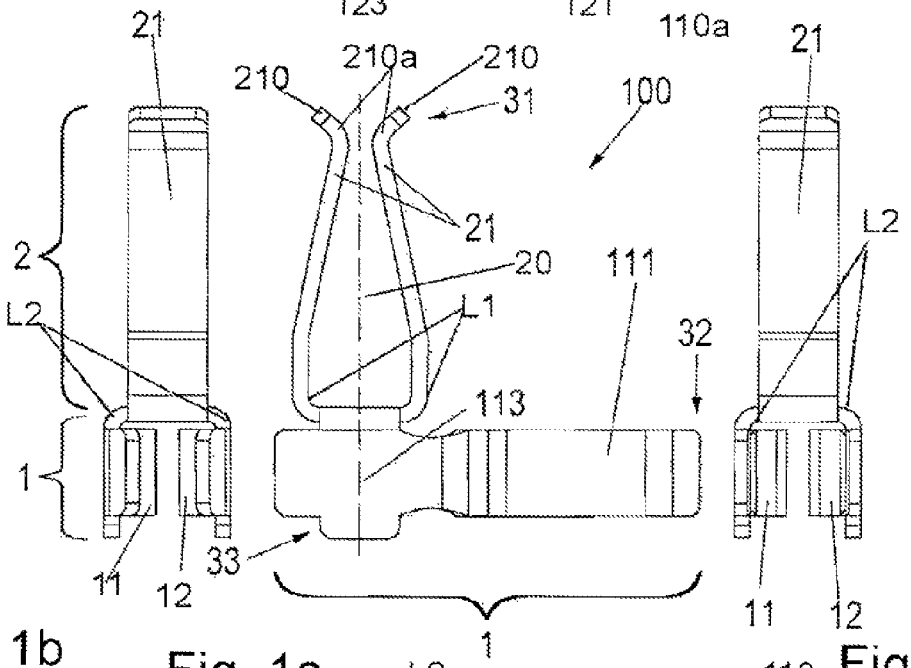
Fig. 1b
Fig. 1a
Fig. 1c
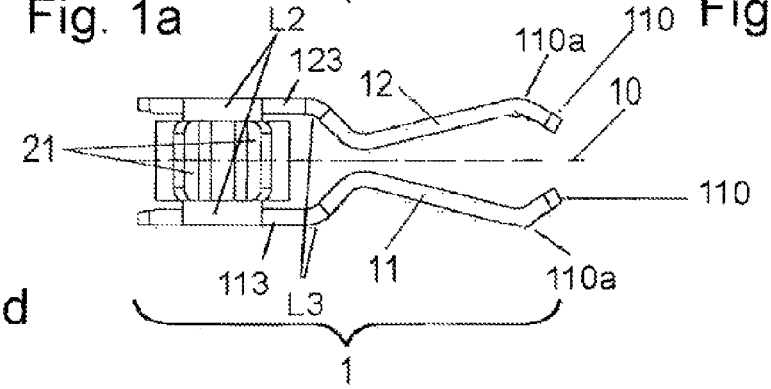
Fig. 1d

Prior Art 100
10
210
21
23
12
110
11
122
112
35

ELECTRICAL CONTACT PART

REFERENCE TO RELATED APPLICATIONS

This application is a national stage under 35 U.S.C. 371 of the International Application No. PCT/EP2011/061985 filed Jul. 13, 2011, which claims priority of the German Application No. 20 2010 010 275.8 filed Jul. 15, 2010.

BACKGROUND OF THE INVENTION

1. Field of the Invention

An electrical contact arrangement includes a planar conductive metal blank having sections that are foldable to define pairs of resilient orthogonally arranged component contacts and bus blade contacts. The component contacts are arranged to receive therebetween an electrical component such as a printed circuit board, and the bus blade components are arranged to connect together a string of the electrical contact arrangements.

2. Description of Related Art

It is known in the prior art to provide switchboard units, for example, for machines or production lines which—for the control and monitoring of sensors, initiators, field units and/or actuators—include connection modules via which they are electrically connected with the machines and the production lines. Here, as a rule, several connection modules are provided in a modular fashion next to each other and are wired with each other to form a connection block. In order to connect the connection modules electrically with each other, there is generally provided a bus arrangement that extends from one connection module to the next, and that comprises one or more bus lines. Such a bus arrangement, as a rule, comprises both signal lines and supply lines.

The German patent No. DE 199 64 156 A1 discloses a switchboard unit where a connection module in each case has a plurality of diagnostic interfaces for the connection of the sensors, initiators, field units, and/or actuators, which by means of bus bars are conducted electrically to the connection contacts to which one can connect a printed circuit board of the connection module. Contact parts (see FIG. 5 on the state of the art) are provided for the power supply. The contact parts, along with a contact fork 201 to which the printed circuit board can be connected, display in each case a knife contact part 202 as well as a terminal contact part 203. When two connection modules are assembled together, the knife contact part of one connection module is connected with the terminal contact part of the adjacent connection module and is electrically contacted. The contact parts therefore constitute the bus line for power supply.

The present invention was developed to provide an improved electrical contact part, in particular, for the relay of a distribution voltage to the extent that it has a greater current load capacity, whereby in a vibration-vulnerable environment, it will ensure continuous and qualitatively high-grade connection, and that will furthermore be easy to connect and install, and that it can be produced at reasonable cost.

The problem is furthermore solved with a connection module with an inventive electrical contact part. The problem is yet again solved with a connection block comprising at least two connection modules with inventive electrical contact parts.

SUMMARY OF THE INVENTION

Accordingly, a primary object of the present invention is to provide an electrical contact arrangement that is formed from a conductive metal sheet having sections that are foldable to define orthogonally arranged pairs of resilient component contacts and bus blade contacts.

According to a more specific object of the invention, the conductive sheet metal blank includes a horizontal rectangular central core section having a pair of opposed side edges to which are connected by first fold lines a pair of rectangular component contact sections that are upwardly bent to define a pair of component contacts for receiving therebetween an electrical component, such as a printed circuit board. Connected with the orthogonally arranged second pair of opposed side edges of the core section are a pair of rectangular support sections that are bent downwardly, whereby a corresponding pair of bus blade contact sections connected with corresponding edges of the support sections extend in vertical parallel spaced relation to define a pair of bus blade contacts. These blade contacts are adapted for insertion between, and in electrical engagement with, the downwardly bent support sections of a corresponding second electrical contact arrangement, whereby a string of the connector arrangements may be connected together.

According to a further object of a modified embodiment of the invention, each of the conductive metal blank support sections may include an extension section that extends from the support section in the opposite direction from the associated blade contact section, whereby when a pair of said contact arrangements are arranged end-to-end, said bus blade contacts of one contact arrangement are adapted to extend in vertical parallel spaced relation in electrical engagement between the extension sections of the companion electrical contact arrangement.

According to an further object of the invention, an electrical contact part for a modular expandable bus line is provided that comprises a contact spring arrangement for the connection of an adjacent electrical contact part, whereby the contact spring arrangement has a first contact spring leg and a second contact spring leg, which are electrically connected with each other, whereby the first contact spring leg and the second contact spring leg comprise a fork segment, whereby, in addition, both the first contact spring leg and the second contact spring leg comprise an orthogonally arranged contact blade segment. Because the contact blade segment includes two contact resilient legs, the current is conducted through both contact blade segments to the adjacent contact part and not only through a single blade. As a result, the current load capacity of the inventive contact part is increased when compared to the state of the art.

The first resilient contact leg and the second resilient contact leg are preferably arranged symmetrically with respect to a vertical first mid-plane, so that a current flowing through the electrical contact part will essentially be equally distributed over both contact spring legs.

Preferably, the first contact spring leg and the second contact spring leg in the area of the fork segments are electrically and preferably also mechanically connected with each other by means of a lateral strut or horizontal central core section that extends laterally with respect to the vertical mid-plane. First of all, the terminal segments of the first and the second contact spring legs as well as the lateral strut as a result essentially form a U-shaped plug-in area into which one can insert the contact blade segments of the adjacent contact part. Besides, the central core section gives the contact part sufficient stiffness. The contact parts therefore can be easily handled. Furthermore, as a result, the contact fork can be made in one piece. Besides, the central core section can be so dimensioned that its current load capacity will correspond to the total current load capacity of both contact spring legs.

In a particularly preferred manner in a plug-in state in which the electrical contact part is connected to an adjacent electrical contact part, one contact blade segment in each case of the electrical contact part rests against a fork segment of the adjacent electrical contact part in an electrically contacting manner so that the current will be distributed upon both contact spring legs also in the adjacent contact part.

The contact spring legs are designed in a resilient manner in each case at least on one of their ends. As a result, the contact blade segment of each contact spring leg in a plug-in state with a reset force will rest on a fork segment of the contact spring leg of the adjacent contact part where the fork segment is not resilient or is generally non-resilient.

Here, the reset force works against an extraction of the contact blade segments out of the plug-in area formed by the fork segments of the adjacent contact part. Compared to a conventional blade that is inserted between the legs of a terminal contact, the inventive contact part offers the advantage that the two contact blade segments due to the reset force of the contact spring legs, so to speak, cannot wiggle themselves free, and that the electrical contact therefore will be established in a very reliable manner even in a vibration-vulnerable environment. This means that the contact blade consists of two individual legs which, upon insertion into the first contact fork, can be pressed together in a resilient manner.

In a likewise preferred manner, the electrical contact part comprises an additional connection means, in particular for the connection of an electrical subassembly. Such a subassembly, for example, is an electrical printed circuit board for a conductor.

The additional connection means is in a particularly preferred manner a second contact fork. In a particularly preferred manner, this second contact fork has two contact fork legs that are arranged parallel to a vertical second mid-plane that extends orthogonally with respect to the first mid-plane. In this embodiment, the second contact fork grasps around a contact means of the electrical subassembly so that the electrical contact is securely established when the electrical contact part is assembled together with the electrical subassembly. Furthermore, this arrangement of the two contact forks parallel to the particularly mutually laterally arranged mid-planes offers the advantage that the plane in which the bus formed by the contact part is arranged outside, for example, above or below the plane in which the electrical subassembly is provided. The electrical subassembly therefore can be connected to the contact part without dipping into the area of the contact fork. In case of faulty assembly, the electrical subassembly therefore does not dip into the area of the contact fork, respectively of the bus, and therefore does not endanger the continuous contacting of additional connected contact parts and thus any further connection module.

In a preferred embodiment, the contact fork legs are connected with each other by means of the central core section so that there is no need for any additional connection means between the first contact fork and the second contact fork. In a particularly preferred manner, the first contact fork and the second contact part are made together with each other in one piece. In this embodiment, the contact part is preferably made as a punched bent component from one piece of electrically conductive sheet metal. Here, the arrangement of the contact fork as well as the contact fork on the central core section facilitates a very space-saving punching pattern so that there will be only very little waste material. As a result, the contact part can be made at very reasonable cost. Furthermore, the contact part can be made with very minor production tolerances and a great degree of stiffness. The resilient effect of the contact spring legs can be achieved by corresponding bending of the contact spring legs.

Even in a vibration-vulnerable environment, the electrical contact part also facilitates a secure bus connection between two adjacent connection modules, in particular for the distribution voltage.

BRIEF DESCRIPTION OF THE DRAWINGS

Other objects and advantages of the invention will become apparent from a study of the following specification, when viewed in the light of the accompanying drawing, in which:

FIG. 1*a* is a side elevation view of a first embodiment of the electrical contact arrangement of the present invention, and FIGS. 1*b*-1*e* are right side, left side, top side and bottom views, respectively, of the apparatus of FIG. 1*a;*

DETAILED DESCRIPTION OF THE INVENTION

Figure 2:
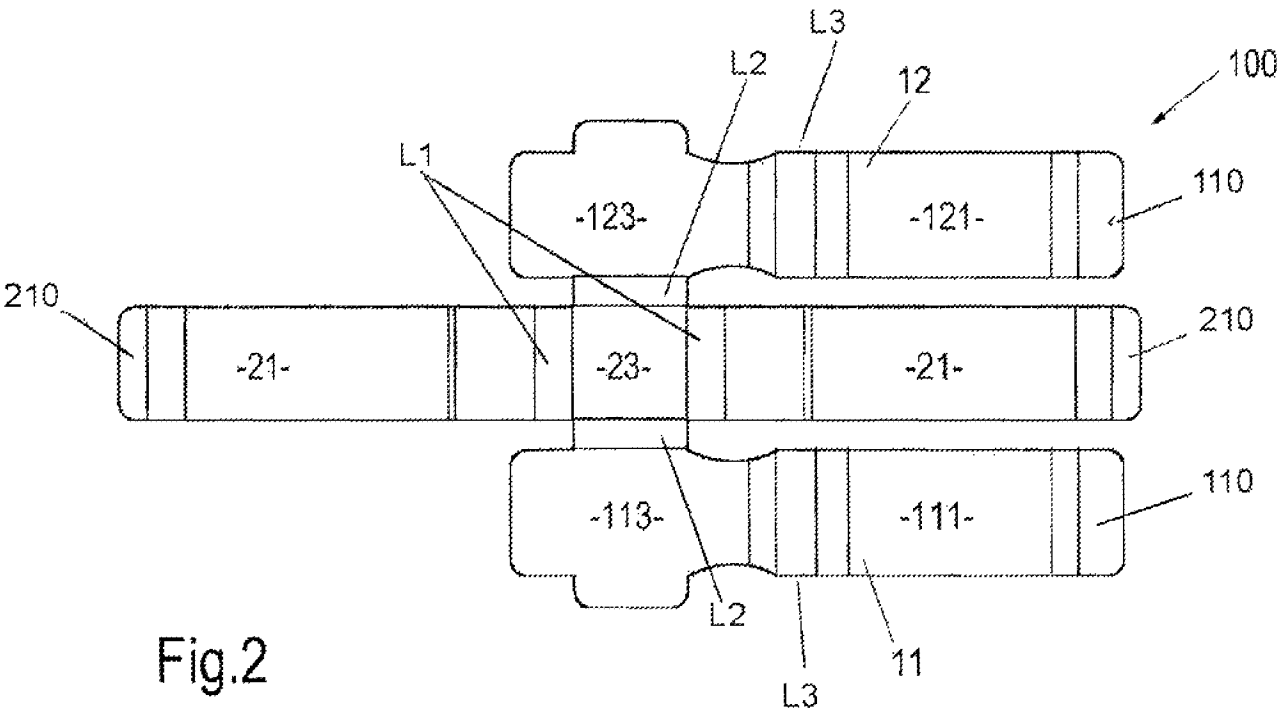
FIG. 2 is a top plan of the conductive sheet metal blank from which the apparatus of FIG. 1*a* is formed.

Referring first to FIG. 2, the contact arrangement 100 of FIGS. 1*a*-1*e* is formed from a conductive sheet metal blank including a rectangular core section 23 having a first pair of opposed side edges that are connected by first fold lines $L_1$ with a pair of component contact sections 21, and a second pair of opposed side edges that are connected by second fold lines $L_2$ with a pair of rectangular support sections 113 and 123. Connected with corresponding side edges of the support sections by third fold lines $L_3$ are a pair of blade contact sections 12 and 111.

The component contact sections 21 are stamped and folded upwardly about the first fold lines $L_1$ to define the tulip-shaped contacts of FIG. 1*a*, which contacts are symmetrical to the vertical plane 20 passing longitudinally therethrough. The upper ends of the contacts 21 have outwardly bent portions 210 that define contact surfaces 210*a*, as will be described below.

The support sections 113 and 123 are folded downwardly around second fold lines $L_2$ toward the vertical positions shown in FIGS. 1*b* and 1*c*, and the blade contact sections are deformed relative to the third fold lines $L_3$ to form bus blade contacts 11 and 12 having the configurations shown in FIGS. 1*d* and 1*e*. In this case, the blade contacts 11 and 12 are resiliently biased apart, and the free end portions 110 of the bus blade contacts are bent inwardly to define the contact surfaces 110*a*, which will be described in greater detail below. The bus blade contacts are spaced and symmetrical relative to the vertical longitudinal central plane 10 (FIG. 1*d*) extending therethrough. The two vertical planes 10 and 20 are orthogonally arranged relative to each other.

Figure 3A:
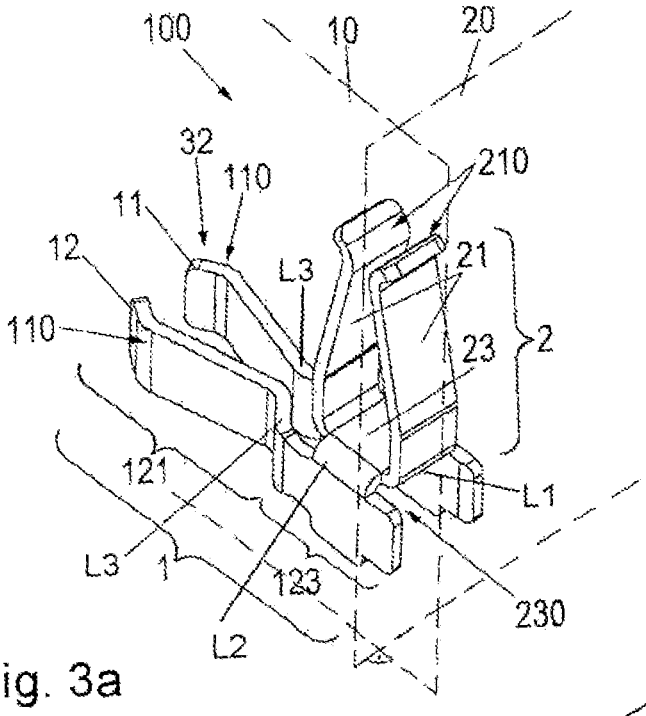
FIG. 3*a* is a front perspective view of the contact arrangement of FIG. 1*a*.
Figure 3B:
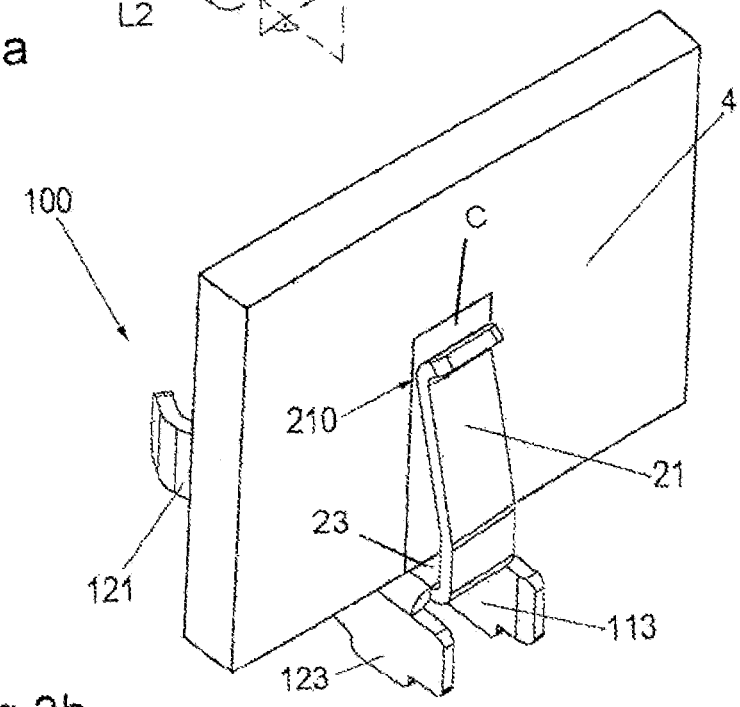
FIG. 3*b* is a perspective view of the apparatus of FIG. 3*a* with an electrical component mounted thereon.

Referring to FIGS. 3*a* and 3*b*, the upper ends of the component contacts 21 are resiliently biased together, whereby when a printed circuit board 4 or similar component is inserted between the contacts with the component lower edge portion being in supported engagement with the horizontal core section 23, the adjacent contact surfaces 210 of the component contacts are biased toward electrical engagement with the conductor C on the printed circuit board. Conceivably, a second horizontal core section could be provided to close the bottom of the space 230 defined between the support sections 123 and 113. Since the printed circuit board is supported by the horizontal core section 23, it does not interfere with the operation of the lower bus bar portion of the contact arrangement.

Figure 4A:
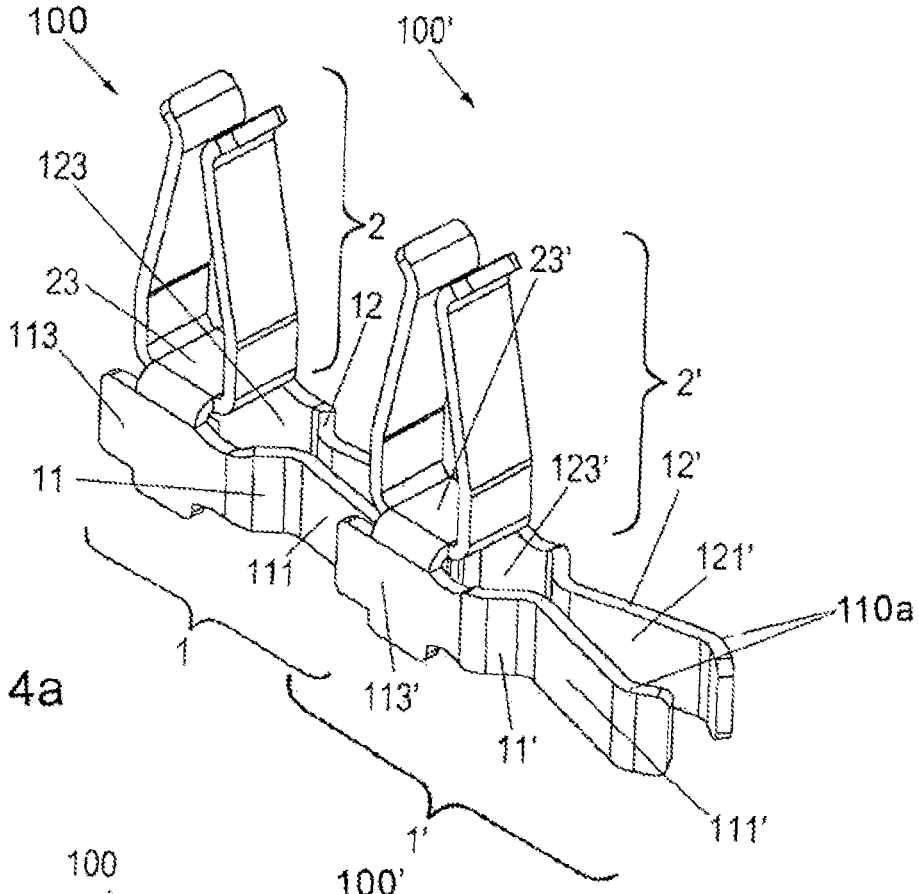
FIG. 4*a* is a front perspective view of an assembly of a pair of the electrical contact arrangements connected together.
Figure 4B:
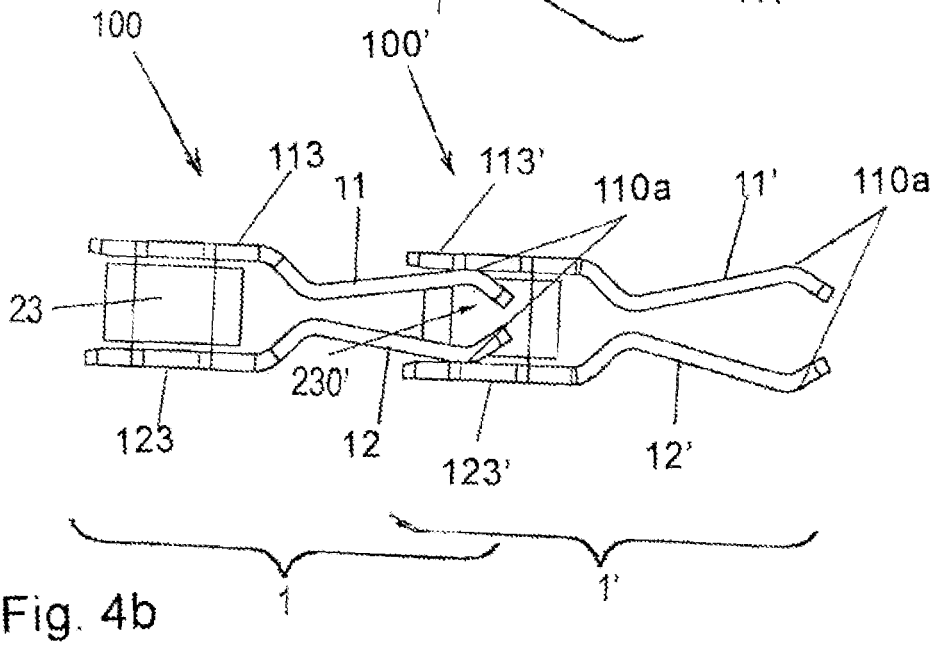
FIG. 4*b* is a bottom view of the apparatus of FIG. 4*a;*

According to an important feature of the invention, a string of the contact arrangements may be connected together in end-to-end relation. More particularly, as shown in FIGS. 4*a* and 4*b*, when the contact arrangements 100 and 100' are arranged end-to-end, the bus blade contacts 11 and 12 of first contact arrangement 110 are inserted into the U-shaped space 230' (FIG. 2*b*) defined between the support sections 113' and 123' of the second contact arrangement 100'. The external surfaces 110*a* of the outwardly resiliently biased bus blade contacts 11 and 12 electrically engage the adjacent inner surfaces of the support sections 113' and 123', as shown in FIG. 4*b*, thereby electrically connecting together the bus bar portions of the contact arrangements. The outwardly biased bus blade contacts therefor resist the withdrawal movement of the first contact arrangement 100 from the second contact arrangement 100'.

Figure 5A:
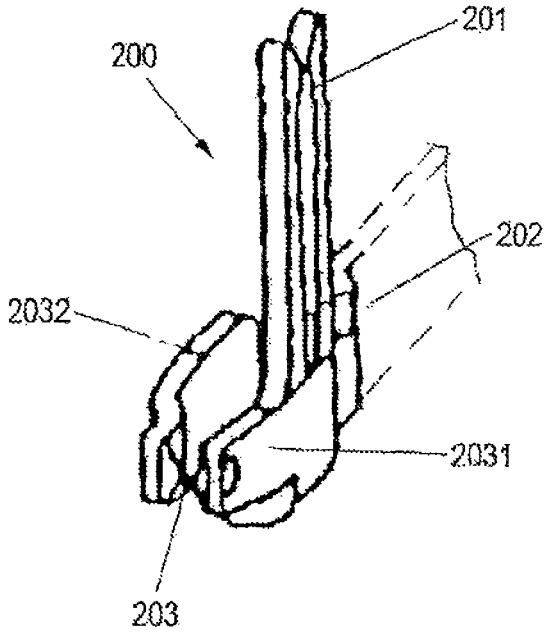
Fig. 5a Prior Art
FIG. 5*a* is a perspective view of a contact arrangement of the prior art.
Figure 5B:
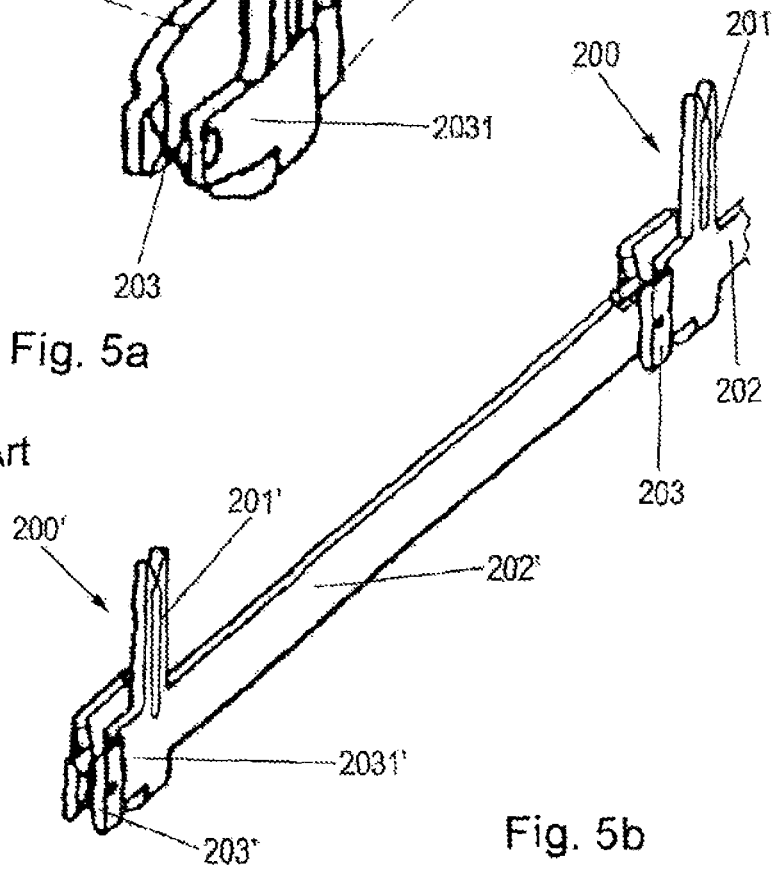
FIG. 5*b* is a perspective view illustrating the manner of connecting together a pair of the devices of FIG. 5*a;*
Figure 6C:
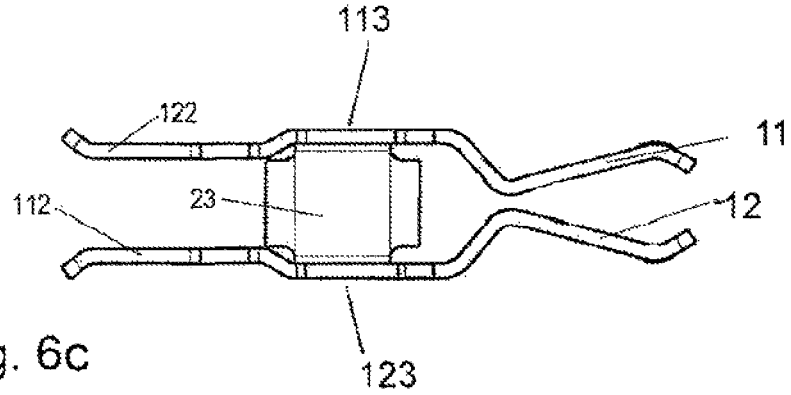
FIGS. 6*b* and 6*c* are top and bottom views, respectively, of the apparatus of FIG. 6*a;*
Figure 6A:
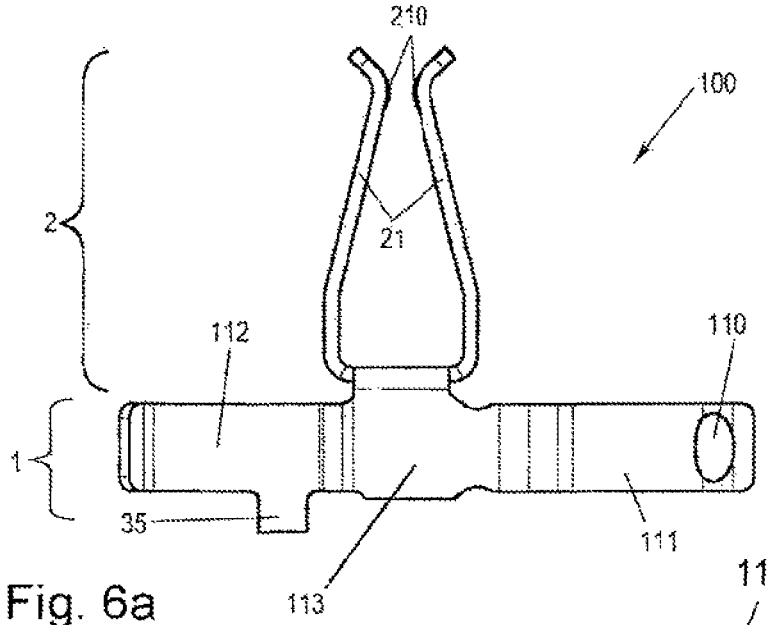
FIG. 6*a* is a side elevation view of a second embodiment of the invention.
Figure 6B:
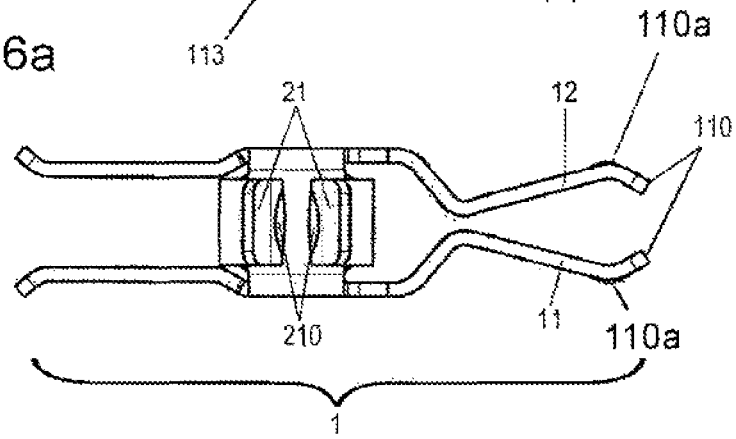
Figure 7:
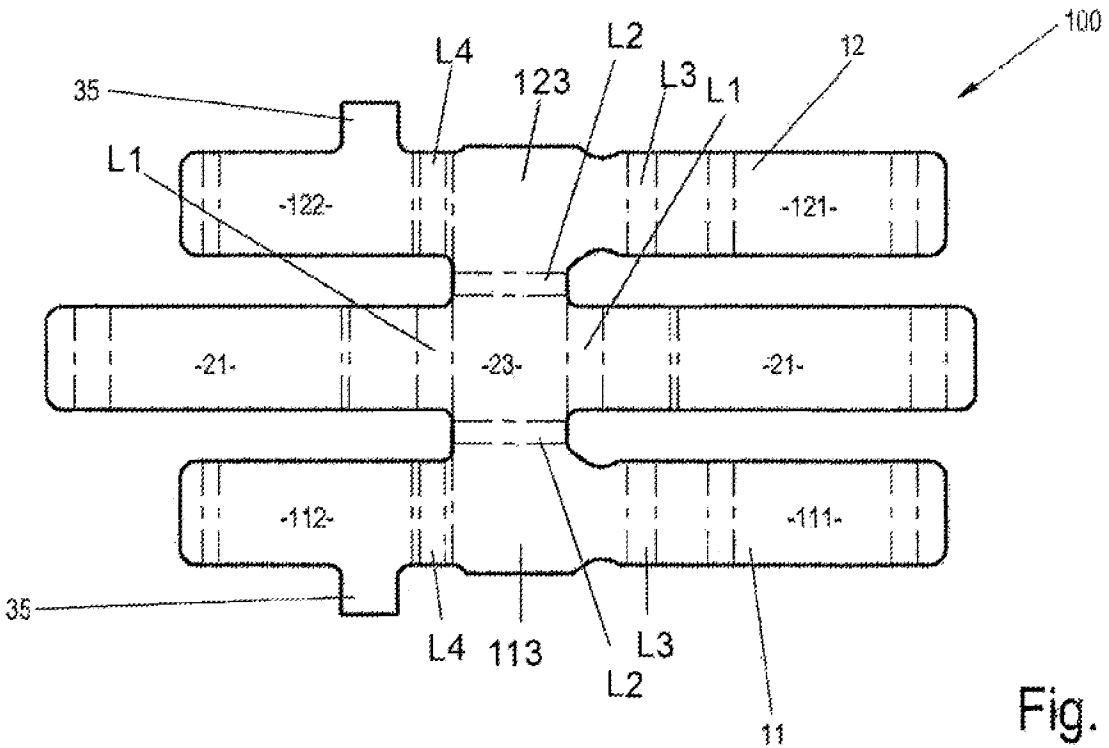
FIG. 7 is a top plan view of the conductive sheet metal blank from which the apparatus of FIG. 6*a* is formed.

In the known prior art arrangement of FIGS. 5*a* and 5*b*, the contact arrangement 200 comprises an upper portion including a pair of component contacts 201 having upper ends that are resiliently biased together, and a socket portion 203 including a pair of resilient arms 2031 and 2032 extending in one direction, and a single connecting arm 202 extending in the opposite direction. In this known arrangement, the contact arrangements 200 and 200' can be connected together in end-to-end fashion by inserting the single connecting arm 202' of the second contact arrangement into the space between the resilient arms of the socket 203 of the first contact arrangement.

As distinguished from the contact arrangement 100 of the present invention shown in FIGS. 1-4, the connecting bar 202 of the prior art device is fashioned merely as an extension as one of the two socket legs 2031 that form the socket 203. Furthermore, the contacts 201 are also arranged only on this socket leg 2031. As a result, the current load capacity of this contact part 200 according to the state of the art is less.

Figures 8A, 8B, 8C:
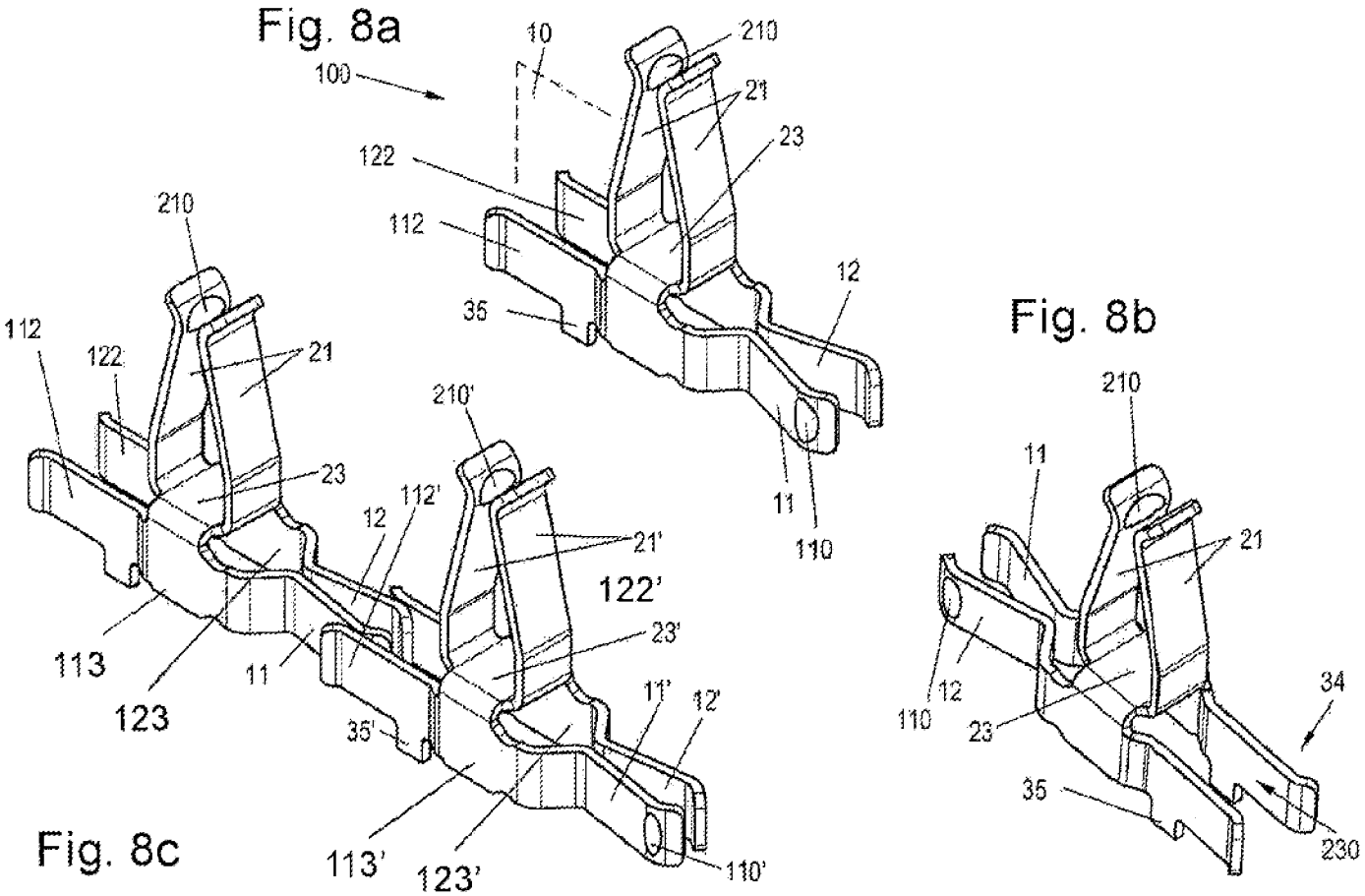
FIGS. 8*a* and 8*b* are front and rear perspective views, respectively, of the apparatus of FIG. 6*a*.
FIG. 8*c* is a perspective view of an assembly of a pair of the contact arrangements of FIG. 8*a*.

Referring now to FIGS. 6*a*-6*c* and 7, according to an alternate embodiment of the invention, the conductive sheet metal blank includes a pair of extension sections 112 and 122 that are connected by fourth fold lines $L_4$ with support sections 113 and 123, respectively, and extend in opposite directions therefrom relative to the bus blade contact sections 111 and 121, respectively. When two of these contact arrangements of FIGS. 8*a* and 8*b* are arranged end-to-end as shown in FIG. 8*c*, the bus blade contacts 11 and 12 of the first contact arrangement are inserted into electrical engagement between the bus extension portions 112' and 122' of the second contact arrangement. As a result, the contact arrangements of this embodiment of the present invention can be used to bridge longer distances.

Furthermore, the two embodiments in FIGS. 6-8 and 9 compared to the embodiment of FIG. 1-4 share in common the fact that on their contact zones 110, 210, there are provided contact enhancement means, for example, a configuration or a coating with a particularly well-conducting material.

Figure 9C:
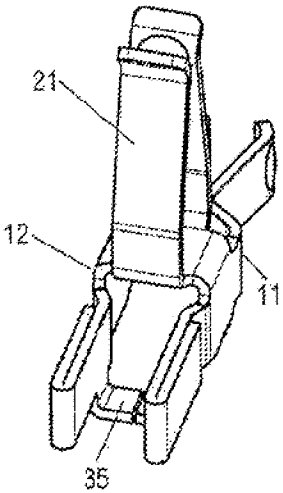
FIGS. 9*a*, 9*b* and 9*c* are a front perspective view, a rear perspective view, and a further rear perspective view, respectively, of a modification of the second embodiment of the invention.
Figure 9B:
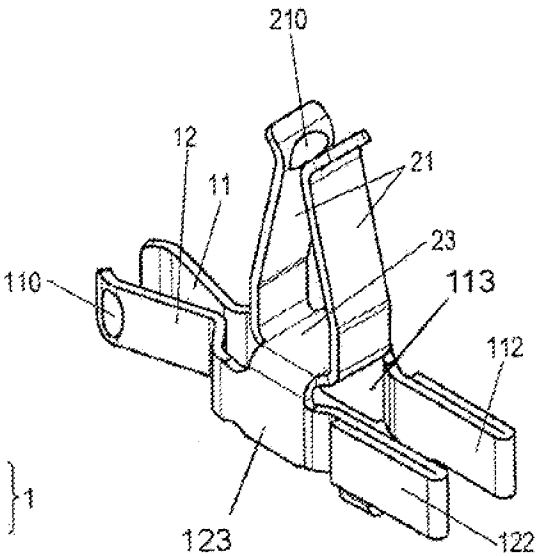
Figure 9A:
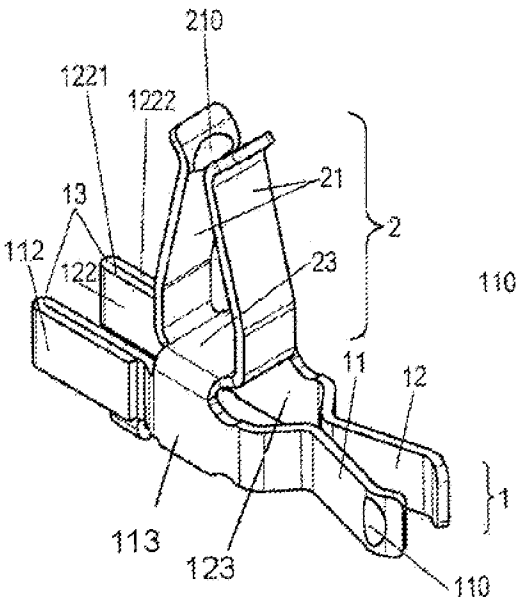

In the modification shown in FIG. 9, the bus blade segments 113, 123 have been further lengthened and in each case show a bend 13 by 180°, whereby the bus blade extensions 112, 122 in each case include two mutually touching leg areas 1121, 1122, 1221, 1222. As a result, the bus blade contact legs 112, 122 are more stable.

Furthermore, lateral strengthening tab 35 may be provided that are inwardly bendable (FIG. 9*c*) to strengthen the bus extension portion of the contact arrangement. In the embodiments of FIGS. 6-8 and 9, the strengthening tabs in each case are provided on the extension legs 112, 122. In the embodiment in FIG. 9, it is furthermore bent by 90° so that it runs laterally with respect to the first and second mid-plane 10, 20, and starting from the extension legs 112, 122, it extends underneath the plug-in area 230. First of all, the fork legs 113, 123 are as a result always spaced apart from each other. Besides, the strengthening tabs 35 facilitate a layout of the bus blade contact spring segments 11, 12 between the blade extension legs 113', 123' of an adjacent contact part 100'.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical contact arrangement for use in a modular expandable bus bar arrangement, comprising:

(a) a planar resilient conductive metal blank (100) including:

(1) a horizontal central rectangular core section (23) having two pairs of opposed side edges;

(2) a pair of generally rectangular component contact sections (21) connected by first fold lines ($L_1$) with an orthogonally arranged first pair of said core section opposed side edges;

(3) a pair of generally rectangular support sections (113, 123) having second side edges connected by second fold lines ($L_2$) with a second pair of said core section opposed side edges; and (4) a pair of bus blade contact sections (111, 121) connected with corresponding side edges of said support sections by third lines ($L_3$) that extend normal to said first fold lines;

(b) said component contact sections being bent upwardly about said first fold lines toward generally vertical positions with their upper ends terminating in adjacent relation, thereby to permit the insertion of an electrical component (4) therebetween;

(c) said support sections being bent downwardly about said second fold lines toward vertical positions in which said bus blade contact sections extend horizontally in spaced relation away from said central core section, thereby to permit connection of said electrical contact arrangement with a similar bus arrangement.

2. An electrical contact arrangement as defined in claim 1, wherein said component contact sections are symmetrically deformed to define fork component contacts (21) that are resiliently biased together toward the vertical central plane (20) passing longitudinally therebetween.

3. An electrical contact arrangement as defined in claim 2, wherein said fork component contacts terminate at their upper free ends in outwardly bent end portions (210), thereby to define a pair of first contact surfaces (210*a*) adapted for engagement with opposite sides of the electrical component.

4. An electrical contact arrangement as defined in claim 2, wherein said third lines are fold lines; and further wherein said bus blade sections are symmetrically deformed to define spaced bus blade contacts (11, 12) that are resiliently biased apart relative to the vertical central plane (10) passing longitudinally therebetween.

5. An electrical contact arrangement as defined in claim 4, wherein when two of said contact arrangements are arranged end-to-end, said bus blade contacts of one contact arrangement are adapted to extend in vertical parallel spaced relation in electrical engagement with the inner surfaces of the support sections of a corresponding second contact arrangement.

6. An electrical contact arrangement as defined in claim 5, wherein said bus blade contacts terminate at their free ends in inwardly bent end portions (110), thereby to define a pair of second contact surfaces (110*a*) adapted for engagement with the inner surfaces of the support sections of the second contact arrangement.

7. An electrical contact arrangement as defined in claim 4, wherein each of said conductive metal blank support sections includes an extension section (112, 122) that extends from the support section in the opposite direction from the associated blade contact section, whereby when a pair of said contact arrangements are arranged end-to-end, said bus blade contacts of one contact arrangement are adapted to extend in vertical parallel spaced relation in electrical engagement between the extension sections of the companion electrical contact arrangement.

8. An electrical contact arrangement as defined in claim 7, wherein each of said extension sections includes a lateral strengthening tab (35) that is inwardly bendable toward a horizontal position for strengthening the relationship between said extension sections.

9. An electrical contact arrangement as defined in claim 8, wherein each of said extension sections includes a reversely folded by strengthening flap (1222).

* * * * *